US006027269A

United States Patent [19]

Yoshida

[11] Patent Number: 6,027,269

[45] Date of Patent: Feb. 22, 2000

[54] DISCHARGED SHEET STACKING APPARATUS AND IMAGE FORMING APPARATUS

[75] Inventor: Masahito Yoshida, Shiki, Japan

[73] Assignee: Canon Kabushiki Kaisha, Tokyo, Japan

[21] Appl. No.: 09/187,399

[22] Filed: Nov. 6, 1998

[30] Foreign Application Priority Data

Nov. 12, 1997 [JP] Japan ..... 9-327029

[51] Int. Cl.[7] ..... B41J 13/10

[52] U.S. Cl. ..... 400/625; 271/209; 347/104

[58] Field of Search ..... 400/624, 625, 400/646, 48; 271/207, 209, 210, 213, 220, 223, 224; 347/102, 104, 105; 346/25

[56] References Cited

U.S. PATENT DOCUMENTS

| | | | |
|---|---|---|---|
| 4,728,963 | 3/1988 | Rasmussen et al. | 346/25 |
| 4,794,859 | 1/1989 | Huseby et al. | 400/625 |
| 4,844,633 | 7/1989 | Greenberg | 400/120 |
| 5,011,315 | 4/1991 | Kitagawa et al. | 400/624 |
| 5,511,770 | 4/1996 | Okazaki | 400/625 |
| 5,709,382 | 1/1998 | Shima | 271/209 |
| 5,745,141 | 4/1998 | Miyawaki | 347/104 |
| 5,746,528 | 5/1998 | Mayer et al. | 400/625 |

*Primary Examiner*—Christopher A. Bennett
*Attorney, Agent, or Firm*—Fitzpatrick, Cella, Harper & Scinto

[57] ABSTRACT

According to a discharged sheet stacking apparatus and an image forming apparatus, in which sheet collecting ability can be improved by preventing scattering of discharged sheets, in order to prevent the scattered stacking when sheets having B5 size longitudinal or A5 size longitudinal are discharged and stacked, a discharged sheet stacking portion is provided with two supporting members (high rib and low rib) constituting a scattering preventing means extending in a direction parallel to a sheet discharging direction.

14 Claims, 5 Drawing Sheets

PRIOR ART

PRIOR ART

DISCHARGED SHEET STACKING APPARATUS AND IMAGE FORMING APPARATUS

BACKGROUND OF THE INVENTION

1. Field of the Invention

The present invention relates to a discharged sheet stacking apparatus for stacking discharged sheets, and, for example, is applied to an image forming apparatus such as an ink jet printer.

2. Related Background Art

In the past, as image forming apparatuses of this kind, there has been proposed ink jet printers for effecting printing by discharging liquid ink onto a printing medium (sheet).

In recent years, since the ink jet printer has advantage of high speed printing and high image quality, it has widely been used in a personal computer, a word processor and a facsimile.

By the way, in general ink jet printers, since the printing is effected by discharging the liquid ink onto the sheet, if an imaged surface of the sheet is contacted with any object or a human's finger before the ink printed on the surface of the sheet is dried, the imaged surface is contaminated.

To avoid this, in recent ink jet printers, a heater is incorporated into the printer to promote the drying of ink or there is provided a discharged sheet stacker (discharged sheet stacking apparatus) for preventing contamination of the imaged surface of the sheet by preventing a succeeding sheet from contacting with the imaged surface of a preceding sheet before the ink on the imaged surface is dried during the continuous printing.

Now, a conventional ink jet printer having such a discharged sheet stacker will be explained with reference to FIGS. 6 and 7.

FIG. 6 is a schematic perspective view of a conventional image forming apparatus (ink jet printer), and FIG. 7 is a schematic front view of the conventional image forming apparatus (ink jet printer).

As shown, in the printer 1, a paper sheet (sheet) 2 is conveyed by an internal sheet conveying mechanism (not shown) during a printing operation and is discharged from a discharge opening 3.

A sheet discharge roller (not shown) and a spur roller (not shown) are provided at the discharge opening 3, thereby feeding out the printed sheet toward a discharging direction while holding the sheet.

The sheet 2 is discharged along upper surfaces of two movable holding members or support members (right support member 4*a* and left support member 4*b*) disposed above a stacking reference surface (stacking portion) 5 which is disposed in front of the discharge opening 3 and on which the printed sheets are ultimately stacked.

Since the sheet 2 is held by the support members 4*a*, 4*b* until a time period required for drying ink on a preceding sheet 6 is elapsed, the sheet 2 is not contacted with the preceding sheet 6.

After the drying time period is elapsed, a means such as a cam shaft (not shown) for driving the support members 4*a*, 4*b* is operated to separate the support members 4*a*, 4*b* from each other by a distance greater than a width of the sheet, thereby dropping the printed sheet 2 onto the preceding sheet 6 rested on a discharged sheet stack portion 4.

In this case, it is important that the support members 4*a*, 4*b* are driven (opened) after the sheet 2 was completely fed out from the sheet discharge roller and the spur roller.

That is to say, if the sheet 2 is fed out from the sheet discharge roller and the spur roller after the support members 4*a*, 4*b* are opened, the succeeding sheet rubs the surface of the preceding sheet during the stacking operation or the sheet is not stacked horizontally.

In this way, after the time period (one sheet or more) required for drying the ink is surely elapsed, the sheet is discharged, thereby preventing the contact between the sheets.

Regrading a size of the sheet, a width of a sheet most available to the printer 1 is set as a maximum printing width of the printer and the discharged sheet stacking apparatus, and the support members 4*a*, 4*b* provided on the discharged sheet stacking apparatus are disposed in alignment with the size of the sheet having the maximum printing width.

When various sheets having different size are used, regardless of the size of the sheet, the sheets to be used are set in the printer 1 so that ends of the sheets abuts against a convey reference 7.

For example, in an example of the prior art, a width 8 of a sheet of fixed form (A4 size longitudinal) is 210 mm, and the support members 4*a*, 4*b* are disposed in alignment with this width.

Thus, in such a printer 1, when a fixed form sheet having a smaller width such as B5 size longitudinal (182 mm) or A5 size longitudinal (142 mm) is used, in the discharged sheet stacker, the sheet is held at only one side (support member 4*a*), i.e., the convey reference 7 side, and is floating at the other side. In the fixed form sheet, since the smaller the width the smaller a length, the sheet is held by inherent rigidity of the sheet itself.

However, in the above-mentioned conventional case, there arose the following problems.

As mentioned above, in the case where the sheet having small width is discharged, when the sheet is held only at one side in the width-wise direction, although the sheet can be held by its inherent rigidity, the other side of the sheet which is not held is suspended.

Thus, when the holding members (support members) are opened to release the holding condition, the sheet is dropped obliquely from the suspended side, and, it is difficult to control the dropping condition.

Accordingly, when a plurality of sheets are discharged continuously, the sheets are scattered at the stacking portion.

Thus, it is troublesome for the operator to collect the sheets.

SUMMARY OF THE INVENTION

The present invention aims to eliminate the above-mentioned conventional drawbacks, and an object of the present invention is to provide a discharged sheet stacking apparatus and an image forming apparatus, in which a sheet collecting ability is improved by preventing the scattering of discharged sheets.

To achieve the above object, according to the present invention, there is provided a discharged sheet stacking apparatus comprising a pair of holding members disposed in alignment with both ends of a sheet to be discharged in a width-wise direction of the sheet and adapted to temporarily hold the sheet to be discharged and then to drop the sheet onto a sheet stacking portion, wherein, when a sheet having a width smaller than a predetermined width is discharged, one edge portion of the sheet is held by only one of the pair of holding members, and further comprising a scattering preventing means for preventing scattering of a sheet when the sheet having the width smaller than the predetermined width is dropped onto the sheet stacking portion by releasing the sheet.

Accordingly, the scattering of the sheet at the sheet stacking portion is prevented by the scattering preventing means.

The pair of holding members may be disposed in alignment with a width of an available sheet having a maximum width so that all of sheets to be discharged are discharged along a convey reference of the above-mentioned one holding member.

The scattering preventing means may include supporting members for supporting the sheet so that an edge of the sheet opposed to the other holding member becomes higher than an edge of the sheet opposed to the one holding member, when the sheet is stacked on the sheet stacking portion.

Accordingly, when the sheet held by only the one holding member is dropped by releasing the holding of the sheet, the sheet is dropped from the edge which is not held by the other holding member, i.e., a suspended edge, so that the suspended edge of the sheet abut against the supporting member and then the sheet is stacked on the sheet stacking portion in such a manner that the sheet is inclined toward the one holding member.

And, even when a plurality of sheets are discharged continuously, the discharged sheets are dropped from the edges (suspended edges) at the other holding member side and then abut against the already stacked sheet and are slid toward the one holding member so that the sheets are successively stacked in an inclined condition, thereby preventing the scattering of the sheets.

The supporting members may be ribs extending substantially in parallel with the sheet discharging direction.

The ribs may be arranged at positions corresponding to widths of sheets to be discharged.

The ribs may be disposed in such a manner that heights of the ribs are gradually increased from a side opposed to the one holding member toward a side opposed to the other holding member.

The ribs may be provided to be able to fall or lay.

Further, to achieve the above object, in an image forming apparatus according to the present invention, there is provided an image forming means for forming an image by an ink jet system, and the sheet on which the image was formed by the image forming means is discharged on the above-mentioned discharged sheet stacking apparatus.

DESCRIPTION OF THE PREFERRED EMBODIMENTS

Figure 1:
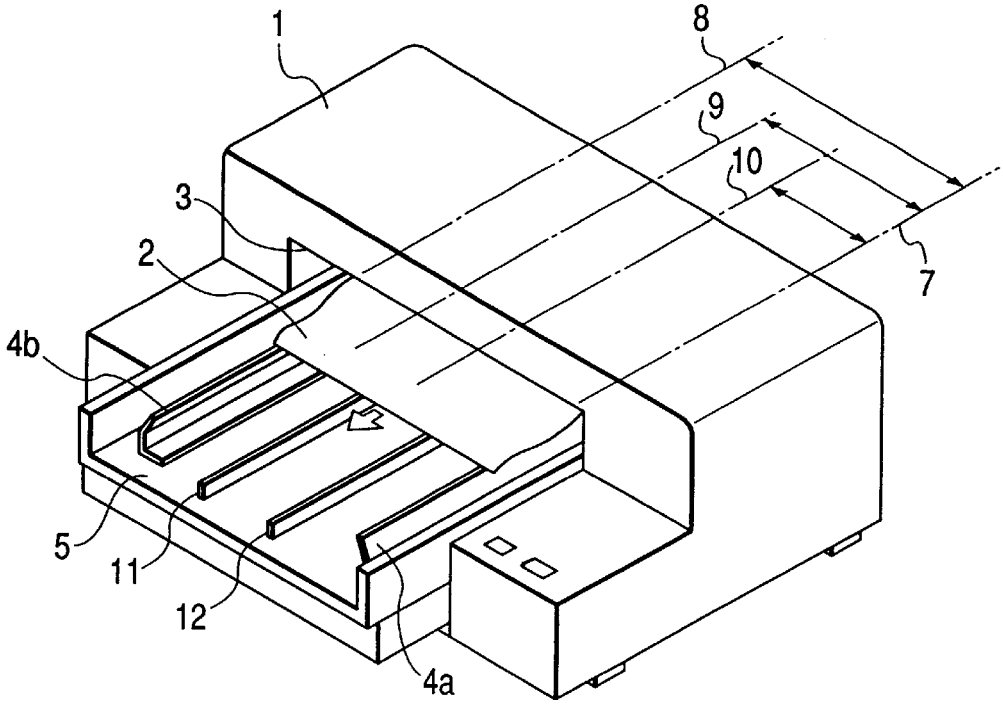
FIG. 1 is a schematic perspective view of an image forming apparatus having a discharged sheet stacking apparatus according to a first embodiment of the present invention.

The present invention will now be explained in connection with embodiments thereof with reference to the accompanying drawings. However, dimensions, material, configurations and relative positions of constructural elements described and shown in the embodiments are not intended to limit the present invention to such ranges, except for special description.

Incidentally, since fundamental construction or arrangement is the same as that already described in connection with the prior art, the same elements as those in the prior art are designated by the same reference numerals and explanation thereof will be omitted.

(First Embodiment)

A discharged sheet stacking apparatus and an image forming apparatus, according to a first embodiment of the present invention will be described with reference to FIGS. 1, 2, 3A, 3B and 4A to 4C.

Figure 2:
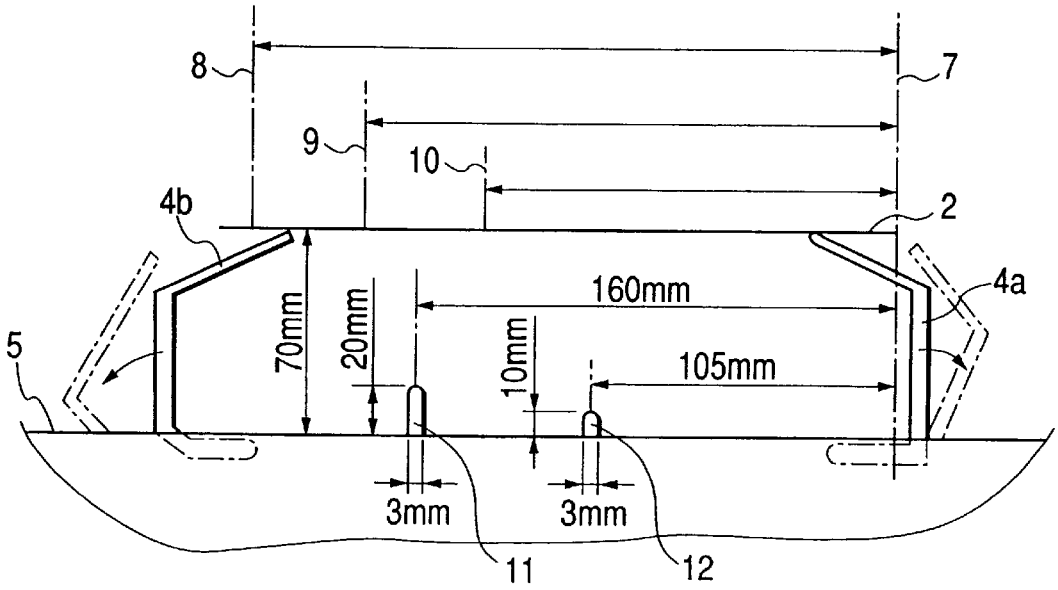
FIG. 2 is a partial front view of the discharged sheet stacking apparatus according to the first embodiment of the present invention.

FIG. 1 is a schematic perspective view of the image forming apparatus having the discharged sheet stacking apparatus according to the first embodiment of the present invention, FIG. 2 is a partial front view of the discharged sheet stacking apparatus according to the first embodiment of the present invention, and FIGS. 3A, 3B and 4A to 4C are views for explaining an operation of the discharged sheet stacking apparatus according to the first embodiment of the present invention.

First of all, a schematic construction of the entire discharged sheet stacking apparatus will be explained with reference to FIGS. 1 and 2.

In the first embodiment, as shown, a printing sheet (sheet) is conveyed along a right (in FIG. 2) convey reference 7, and, regarding widths of sheets, as shown by the dot and chain lines, A4 size longitudinal (210 mm) width (maximum width) 8, B5 size longitudinal (182 mm) width 9 and A5 size longitudinal (148 mm) width 10 which are fixed form smaller than the maximum width are available.

In the illustrated embodiment, a pair of support members (holding members) 4*a*, 4*b* are disposed in correspondence to the width (maximum width) 8, so that both edges (left and right edges in FIG. 2) of the sheet discharged after the printing are held by the support members.

In order to prevent the scattered stacking when the sheets having B5 size longitudinal or A5 size longitudinal are discharged and stacked, a discharged sheet stacking portion is provided with two supporting members (high rib 11 and low rib 12) constituting a scattering preventing means extending in a direction parallel to a sheet discharging direction.

For example, the high rib 11 may have a thickness of about 3 mm and a height of about 20 mm (from a stacking reference surface 5) and a center of the rib may be spaced apart (inwardly) from the convey reference 7 by about 160 mm.

For example, the low rib 12 may have a thickness of about 3 mm and a height of about 10 mm (from the stacking reference surface 5) and a center of the rib may be spaced apart (inwardly) from the convey reference 7 by about 105 mm.

For example, a distance from the stacking reference surface 5 to a sheet holding position may be selected to about 70 mm, and overlap for holding the sheet 2 by the support member 4*a* at the convey reference 7 may be selected from about 20 mm to 40 mm.

Next, an operation effected when a sheet having B5 size longitudinal (as a sheet having a width smaller than a predetermined width) will be explained with reference to FIGS. 3A and 3B.

Figure 3A:
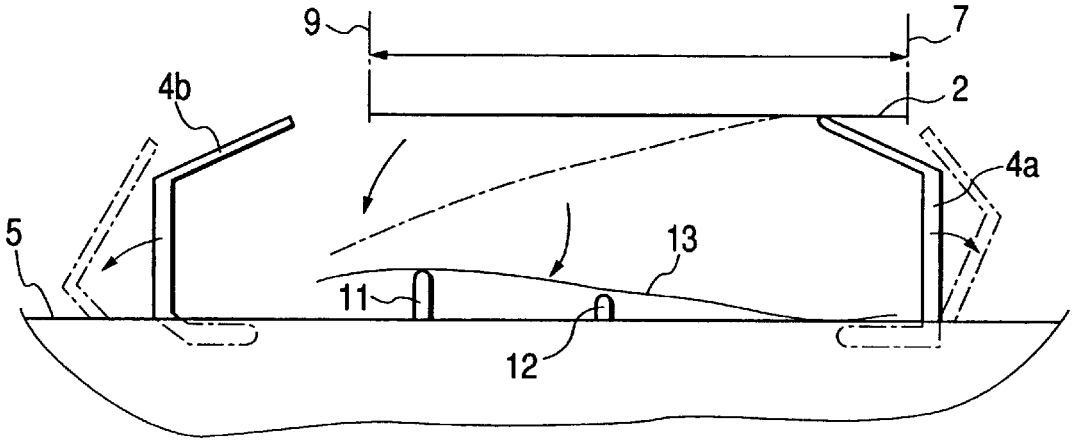
FIGS. 3A, 3B and 4A, 4B and 4C are views for explaining an operation of the discharged sheet stacking apparatus according to the first embodiment of the present invention.
Figure 3B:
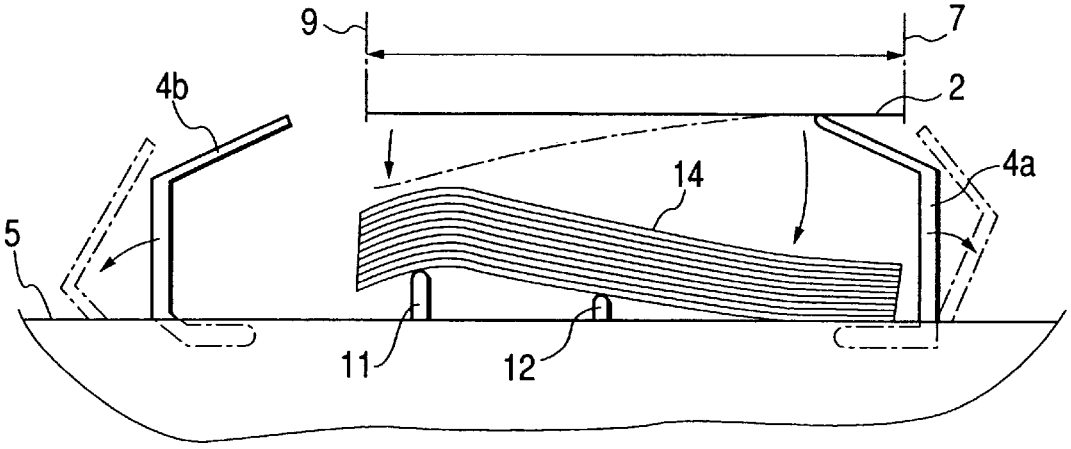

FIGS. 3A and 3B are front views showing movement of the sheets having B5 size longitudinal when the holding of the sheet is released. More specifically, FIG. 3A shows the movement of a first sheet, and FIG. 3B shows the movement of n-th sheet ("n" indicates the plural number).

When the sheet is completely fed out by the sheet discharge roller and the spur roller, in almost cases, before the support member 4*a* at the reference side is shifted outwardly, the sheet 2 is dropped obliquely toward a direction shown by the arrow, i.e., a direction away from the convey reference 7, as shown by the dot and chain line.

The dropped sheet 2 is firstly contacted with the top of the high rib 11 to stop the movement of the sheet away from the convey reference 7 and is stacked as a sheet 13 as shown in FIG. 3A.

As shown in FIG. 3B, when a new sheet is stacked on the already stacked sheets, since the already stacked sheets 14 are inclined, the small fixed form sheet having B5 longitudinal to be stacked is similarly moved and stacked, as is in FIG. 3A.

Further, since the sheets are stacked in an inclined condition that a side of the sheet stack near the convey reference 7 is lowered, the sheet newly stacked on the sheet stack is slid by its own weight toward the convey reference 7 to align the sheets together, thereby preventing the scattering of the sheets.

Next, an operation effected when a sheet having A5 size longitudinal (as a sheet having a width smaller than a predetermined width) will be explained with reference to FIGS. 4A to 4C.

Figure 4A:
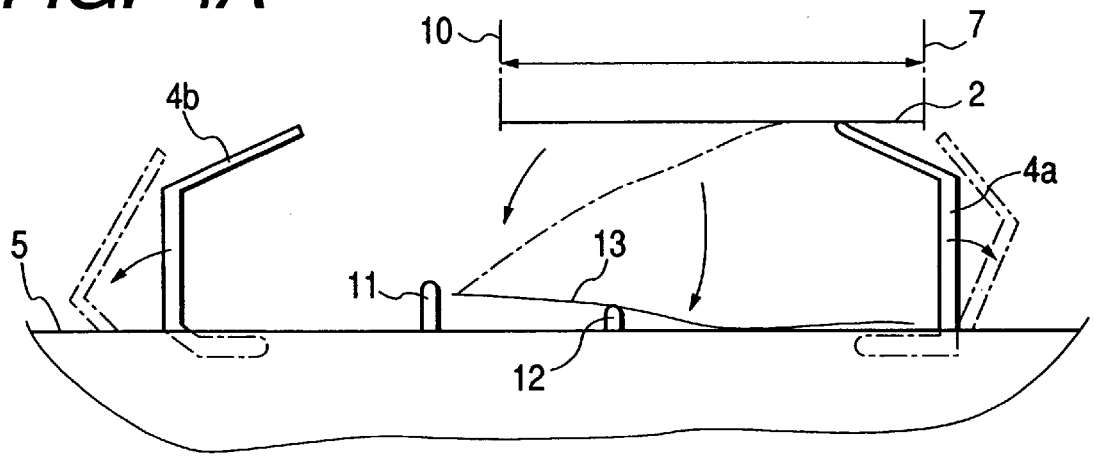
Figure 4B:
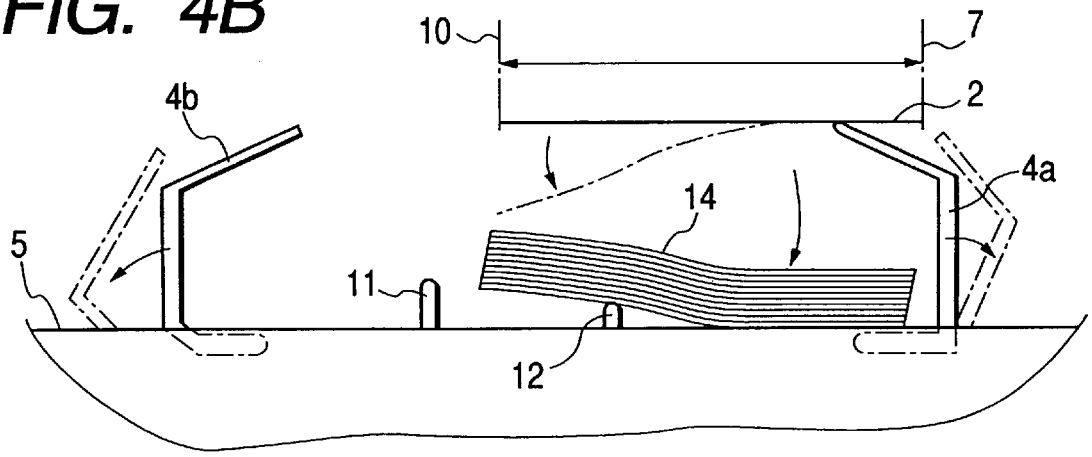

FIGS. 4A and 4B are front views showing movement of the sheets having A5 size longitudinal when the holding of the sheet is released. More specifically, FIG. 4A shows the movement of a first sheet, and FIG. 4B shows the movement of n-th sheet.

Similar to the sheet having B5 size longitudinal, also in case of the sheet having A5 size longitudinal, when the sheet is completely fed out by the sheet discharge roller and the spur roller, in almost cases, before the support member 4*a* at the reference side is shifted outwardly, the sheet 2 is dropped obliquely toward a direction shown by the arrow, i.e., a direction away from the convey reference 7, as shown by the dot and chain line.

In case of the sheet having A5 size longitudinal, since the width of the sheet is smaller than the width of the sheet having B5 size longitudinal, a distance up to the stacking reference surface 5 is increased when inclined, with the result that the sheet 2 is dropped toward the direction away from the convey reference 7 with a force stronger than that in the sheet having B5 size longitudinal.

An end of the dropped sheet 2 is contacted with a side surface (near the convey reference) of the high rib 11 to stop the movement of the sheet away from the convey reference 7 and is stacked as a sheet 13 as shown in FIG. 4A.

As shown in FIG. 4B, the stacked sheets 14 are rested in an inclined condition by the effect of the low rib 12, and the stacking position is gradually lifted to reduce a distance between the sheet holding position and the stacking surface.

Accordingly, in a case where a new sheet having A5 size longitudinal is stacked on the already stacked sheets, as is in the sheet having B5 size longitudinal, the force for moving the sheet away from the reference 7 is reduced only when the rear surface of the sheet is contacted with the sheet stack, thereby preventing the scattering of the sheet.

In this way, also in case of the sheet having A5 size longitudinal, since the sheets are successively stacked in an inclined condition that a side of the sheet stack near the convey reference 7 is lowered, the sheet newly stacked on the sheet stack is slid toward the convey reference 7, thereby preventing the scattering of the sheets.

As mentioned above, regarding the discharging of the sheet having the width smaller than the predetermined width, in a case where the sheet is held by only one of the holding members provided in the width-wise direction of the sheet, even when the sheet is dropped by releasing the holding of the sheet, since the supporting members (ribs) are provided, the scattering of the sheets can be prevented, with the result that the operator can easily collect the sheets thereby improving the operability.

In the above-mentioned embodiment, while an example that three kinds of fixed form sheets are used was explained, when the present invention is applied to an apparatus in which more kinds of sheets are discharged, by providing more supporting members (ribs) at positions corresponding to widths of such sheets, various sheets can be handled while preventing the scattering of the sheets.

In this case, as mentioned above, by designing so that heights of the ribs are gradually increased as the ribs are more spaced apart from the convey reference 7, when the sheet having smaller width is discharged and dropped, the ribs act as guides for preventing the scattering of the sheet away from the convey reference 7 (preventing the scattering of the sheet by abutting the sheet against the side wall of the rib located at the position outside of the width of the sheet), and the sheets are stacked in the smoothly inclined condition toward the convey reference 7, thereby enhancing the effect.

Figure 4C:
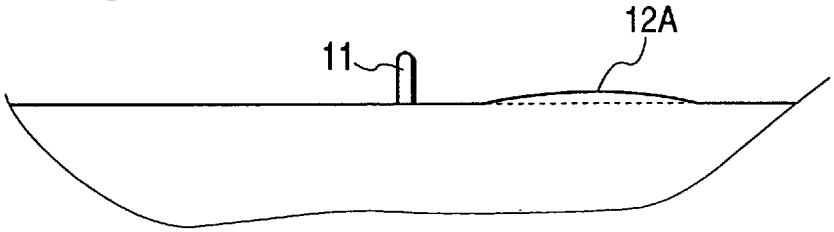

Further, as shown in FIG. 4C, in place of the rib 12, by providing a convex portion 12A having a height same as the height of the rib 12 on the stacking reference surface, the same effect can be expected.

(Second Embodiment)

Figure 5:
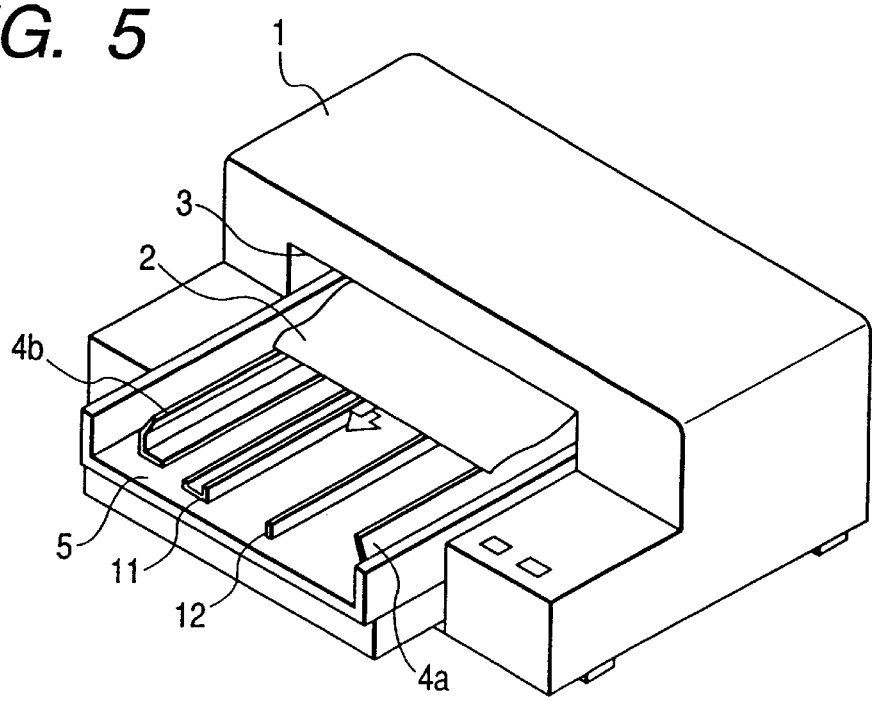
FIG. 5 is a schematic perspective view of an image forming apparatus having a discharged sheet stacking apparatus according to a second embodiment of the present invention.
Figure 6:
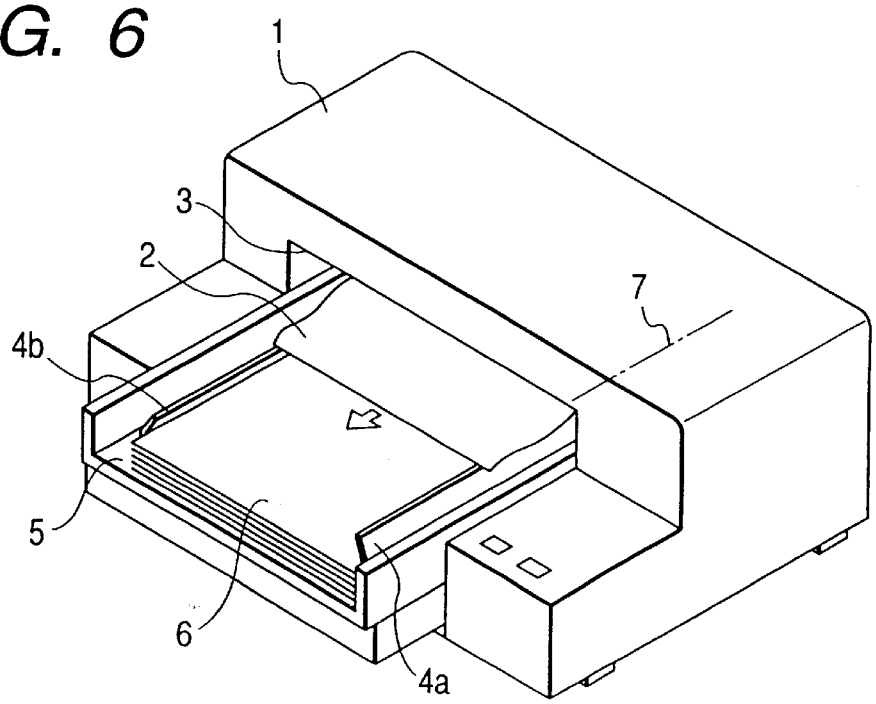
FIG. 6 is a schematic perspective view of a conventional image forming apparatus.
Figure 7:
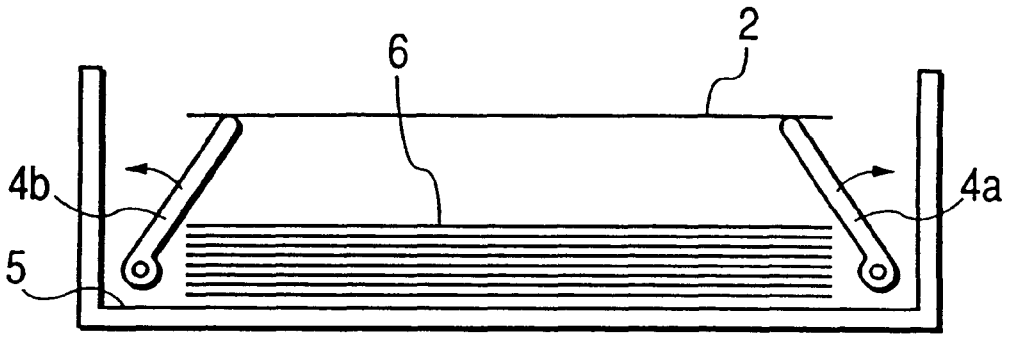
FIG. 7 is a schematic front view of the conventional image forming apparatus.

FIG. 5 shows a second embodiment of the present invention. In the second embodiment, the rib illustrated in the first embodiment can be laid.

Since the other construction and function are the same as those in the first embodiment, the same elements as those in the first embodiment are designated by the same reference numerals and explanation thereof will be omitted.

FIG. 5 is a schematic perspective view of an image forming apparatus having a discharged sheet stacking apparatus according to the second embodiment of the present invention.

In this embodiment, the rib can be laid laterally so that, if the rib is not required, the rib is laid laterally to be housed below the stacking reference surface 5.

Incidentally, in the construction shown in FIG. 5, only the high rib 11 (among the high rib 11 and the low rib 12) can be laid laterally.

That is to say, when the standard sheet having A4 size longitudinal is discharged and stacked, the sheet is normally curled toward the printed surface as the ink is dried. In this case, by laying the high rib 11 laterally, since only the low rib 12 is protruded from the stacking reference surface 5, the sheet can forcibly be curled outwardly, thereby removing the curl from the sheet.

Incidentally, it should be noted that both the high rib 11 and the low rib 12 can be laid laterally so that the operator can lay one of the ribs laterally on demand.

In the discharged sheet stacking apparatus according to the present invention, since the scattering preventing means is provided, the scattering of the sheets at the sheet stacking portion can be prevented, thereby improving the operability for sheet collection.

By providing the scattering preventing means, the dropped sheet abuts against the supporting member and then is stacked on the sheet stacking portion to be inclined toward one of the holding members. Further, when the sheets are discharged continuously, since the sheet is contacted with the already stacked sheet to be slid toward one of the holding members and, thus, the sheets are successively stacked in the inclined condition, the scattering of the sheets can be prevented.

The supporting members may be ribs extending in a direction parallel with the sheet discharging direction.

By providing the ribs at positions in correspondence to widths of the sheets to be discharged, the scattering of various sheets can be prevented.

In this case, by setting so that the height of the ribs are gradually increased from the side opposed to one of the holding members toward the other holding member, the scattering of the sheet can be prevented by the existence of the wall of the rib and the sheets can be stacked in the smoothly inclined condition, thereby enhancing the effect.

When the rib can be laid, the rib(s) which is(are) not required can be housed below the stacking reference surface.

Further, the above-mentioned discharged sheet stacking apparatus having good collecting ability can be applied to an image forming apparatus for forming an image by an ink jet system.

What is claimed is:

1. A discharged sheet stacking apparatus comprising:

a pair of holding members and a sheet stacking portion, the pair of holding members disposed respectively on both side edges of a sheet to be discharged to temporarily hold the sheet to be discharged and then to drop the sheet onto the sheet stacking portion, wherein when the sheet to be discharged has a width smaller than a predetermined width, only one of the side edges of the sheet is held by a one of said pair of holding members; and a scattering preventing means for preventing scattering of the sheet when the sheet having the width smaller than the predetermined width is dropped onto said sheet stacking portion by releasing the holding of the sheet with the one of said pair of holding members.

2. A discharged sheet stacking apparatus according to claim 1, wherein said pair of holding members are disposed in alignment with a width of a sheet having a maximum width in sheets being dischargeable so that all of the sheets to be discharged are discharged along a convey reference of the one of said pair of holding member.

3. A discharged sheet stacking apparatus according to claim 1 or 2, wherein said scattering preventing means includes supporting members for supporting the sheet so that an edge of the sheet opposed to the other holding member becomes higher than an edge of the sheet opposed to the one of said pair of holding members, when the sheet is stacked on the sheet stacking portion.

4. A discharged sheet stacking apparatus according to claim 3, wherein said supporting members are ribs extending substantially in parallel with a sheet discharging direction.

5. A discharged sheet stacking apparatus according to claim 4, wherein said ribs are arranged at positions corresponding to widths of the sheets to be discharged.

6. A discharged sheet stacking apparatus according to claim 5, wherein said ribs are disposed in such a manner that heights of said ribs are gradually increased from a side opposed to the one of said pair of holding members toward a side opposed to the other holding member.

7. A discharged sheet stacking apparatus according to claim 4, wherein said ribs can be laid.

8. An image forming apparatus comprising:

image forming means for forming an image on a sheet by an ink jet system;

a discharged sheet stacking apparatus having a pair of holding members and a sheet stacking portion, the pair of holding members disposed respectively on both side edges of a sheet to be discharged to temporarily hold the sheet to be discharged and then to drop the sheet onto the sheet stacking portion, wherein when the sheet to be discharged has a width smaller than a predetermined width, only one of the side edges of the sheet is held by a one of said pair of holding members; and a scattering preventing means for preventing scattering of the sheet when the sheet having the width smaller than the predetermined width is dropped onto said sheet stacking portion by releasing the holding of the sheet with the one of said pair of holding members.

9. An image forming apparatus according to claim 8, wherein said pair of holding members are disposed in alignment with a width of a sheet having a maximum width in sheets being dischargeable so that all of the sheets to be discharged are discharged along a convey reference of the one of said pair of holding members.

10. An image forming apparatus according to claim 8 or 9, wherein said scattering preventing means includes supporting members for supporting the sheet so that an edge of the sheet opposed to the other holding member becomes higher than an edge of the sheet opposed to the one of said pair of holding members, when the sheet is stacked on the sheet stacking portion.

11. An image forming apparatus according to claim 10, wherein said supporting members are ribs extending substantially in parallel with a sheet discharging direction.

12. An image forming apparatus according to claim 11, wherein said ribs are arranged at positions corresponding to widths of the sheets to be discharged.

13. An image forming apparatus according to claim 12, wherein said ribs are disposed in such a manner that heights of said ribs are gradually increased from a side opposed to the one of said pair of holding members toward a side opposed to the other holding member.

14. An image forming apparatus according to claim 11, wherein said ribs can be laid.

* * * * *

UNITED STATES PATENT AND TRADEMARK OFFICE

CERTIFICATE OF CORRECTION

PATENT NO. : 6,027,269

DATED : February 22, 2000

INVENTOR(S): MASAHITO YOSHIDA

It is certified that error appears in the above-identified patent and that said Letters Patent is hereby corrected as shown below:

COLUMN 2:
Line 10, "Regrading" should read --Regarding--;
Line 16, "size" should read --sizes--; and
Line 18, "abuts" should read --abut--.

COLUMN 3:
Line 22, "abut" should read --abuts--.

COLUMN 7:
Line 16, "are" should read --is--; and
Line 48, "member." should read --members--.

Signed and Sealed this

Twentieth Day of February, 2001

*Attest:*

Nicholas P. Godici

NICHOLAS P. GODICI

*Attesting Officer*

*Acting Director of the United States Patent and Trademark Office*